US006022018A

United States Patent [19]

Zimmermann et al.

[11] Patent Number: 6,022,018

[45] Date of Patent: Feb. 8, 2000

[54] ARRANGEMENT FOR POSITIONING FLAT ARTICLES

[75] Inventors: Armin Zimmermann; Peter Enenkel, both of Constance, Germany

[73] Assignee: Siemens Aktiengesellschaft, Munich, Germany

[21] Appl. No.: 09/136,414

[22] Filed: Aug. 19, 1998

[30] Foreign Application Priority Data

Aug. 19, 1997 [DE] Germany ..... 197 36 011

[51] Int. Cl.[7] ..... B65H 39/10

[52] U.S. Cl. ..... 271/220; 271/224; 414/794.4

[58] Field of Search ..... 271/220, 223, 271/224; 414/407, 794.4

[56] References Cited

U.S. PATENT DOCUMENTS

| | | | |
|---|---|---|---|
| 2,821,391 | 1/1958 | Buccione | 271/224 |
| 4,068,839 | 1/1978 | Bullock et al. . | |
| 4,493,484 | 1/1985 | Eyer . | |
| 4,838,539 | 6/1989 | Zimmermann | 271/220 |
| 5,332,210 | 7/1994 | Silverberg et al. | 271/224 |
| 5,618,038 | 4/1997 | Hutson | 271/220 |
| 5,685,536 | 11/1997 | Barthold | 414/907 |

FOREIGN PATENT DOCUMENTS

| | | | |
|---|---|---|---|
| 1181132 | 11/1964 | Germany | 271/224 |
| 3224056A1 | 1/1983 | Germany . | |
| 3642021A1 | 6/1988 | Germany . | |
| 3922045Al | 1/1991 | Germany . | |
| 19624968C1 | 1/1998 | Germany . | |
| 143172 | 6/1988 | Japan | 271/224 |
| 789015 | 1/1958 | United Kingdom . | |

*Primary Examiner*—Christopher P. Ellis
*Assistant Examiner*—Gregory A. Morse
*Attorney, Agent, or Firm*—Venable; George H. Spencer

[57] ABSTRACT

An arrangement for positioning flat articles, transported inside a container with straight sides. For a gentle positioning of flat articles of varied thickness and mass, which are transported at high speed into the container having a pivot bearing is provided. The location of the pivot bearing, the length and the pivoting range of the rigid member are selected such that for a return movement of the article out of the container, the pivot bearing is located in the return movement direction in front of the point of contact on the side. As a result and owing to non-reversibility, the article is clamped between the container wall or between the articles present therein and the rigid member (2).

16 Claims, 2 Drawing Sheets

ARRANGEMENT FOR POSITIONING FLAT ARTICLES

CROSS-REFERENCE TO RELATED APPLICATION

This application claims the rights of priority of Patent Application No. 197 36 011.4 filed in Germany on Aug. 19, 1997, the subject matter of which is incorporated herein by reference.

BACKGROUND OF THE INVENTION

The invention concerns an arrangement for positioning flat articles, which are transported inside a container with straight sides.

When sorting and conveying flat articles, these are deposited at high speed into the container, for which process they must be slowed down. The same is true when sorting articles, e.g. letters and mailing pouches, into sorting compartments and for the transfer of articles into containers when changing the conveying principle, e.g. from transporting in a longitudinal direction to transporting in a lateral direction.

A solution is disclosed in German Patent DE 196 24 968.6, published Jan. 15, 1998, for which the articles in an intermediate storage area are placed horizontally into a bin, serving as a container. For this operation, flexible pieces of sheet metal that slow down and clamp in the articles are arranged at an angle inside the bin to slow down and position the articles. The articles are subjected to high mechanical stresses during this operation, which can destroy sensitive articles. Since the articles can have a varied thickness and mass, it is not possible to position them inside the bin, such that they are aligned. Providing an offset on the sheet metal piece for securing the position will exert too much stress on the articles, since the kinetic energy of the articles must be dissipated immediately, without buffering.

SUMMARY OF THE INVENTION

The present invention is based on solving the problem of carefully positioning in a specified end position flat articles with a varied mass and thickness, which are transported at high speed inside a container with straight sides by preventing an uncontrolled return movement of the articles, resulting from a rebounding on a baffle plate.

The article is clamped in securely during a return movement, regardless of its thickness and mass, by a rigid member that can be pivoted into the container in the direction of the feed-in and feed-out movement of the articles and the selection of the location for the pivot bearing—the contact point between the rigid member and the article being respectively transported into the container is always located in front of the pivot bearing in case of a possible return movement—wherein the return movement covers only a very short, defined path.

In accordance with another aspect of the invention, the force acting counter to a limitation is generated by a spring element, acting upon the rigid member. According to a further aspect of the invention, a buffering element acts upon the rigid member to avoid undesirable vibrations of the rigid member.

According to a further aspect of the invention, it is advantageous if the rigid member is provided with varied friction coefficients to help the articles slide along the rigid member when the articles are moved into the container and to help detain them during the return movement.

In accordance with another aspect of the invention, it is also advantageous if the baffle plate is designed such that the kinetic energy of the flat articles is at least reduced.

According to the present invention, if articles covering a wide range of thickness and mass are to be processed, it makes sense to limit the pivoting range of the rigid member by means of an end stop, such that the very light, thin and sensitive articles are conveyed directly to the baffle plate with the aid of an advantageous guiding device, without making contact with the rigid member. For this, the baffle plate is designed in such a way that the kinetic energy of these light articles is nearly neutralized. The baffle plate is provided for this with an elastic surface and/or a resilient and buffered positioning.

According to another aspect of the invention, it makes sense if movable containers, which are loaded at a specific location, are provided with an opening on the side through which the rigid member that is fixedly installed at the loading station and, if necessary, the guiding device can project pivoting into the container.

According to another aspect of the invention, if the arrangement is used for stacking compartments of sorting machines, a rigid member is installed such that it can pivot on each guiding device, provided for respectively one stacking compartment, which guides the articles into the stacking compartment, such that the articles are clamped in during the return movement, thereby resulting in a clean stacking picture for further processing.

BRIEF DESCRIPTION OF THE DRAWINGS

In the following, the invention is explained in further detail with the aid of exemplary embodiments, wherein.

DETAILED DESCRIPTION OF THE PREFERRED EMBODIMENTS

Figure 1:
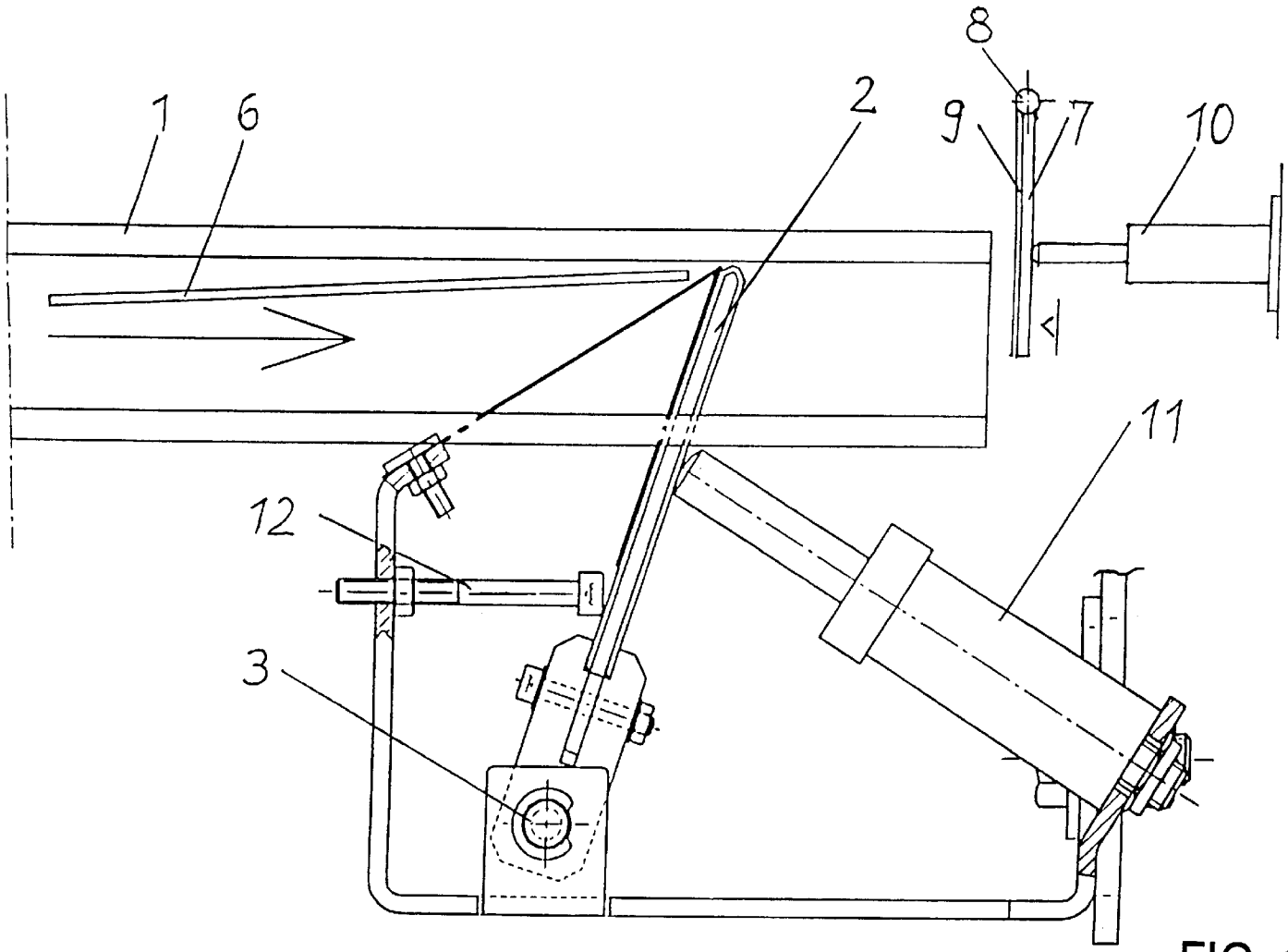
FIG. 1 Shows a schematic top view of a container for accommodating a flat article at a loading station.

According to FIG. 1, the flat articles 6 are transported horizontally at high speed, from the left and standing upright, by way of a conveying system into a locally fixed container 1 that is open on the side.

The flat articles 6 are slowed down and aligned inside this container 1. Subsequently, the articles 6 drop with reduced speed by way of an opening mechanism (not shown) in the bottom of container 1 into transport containers, which then remove the articles 6 in a horizontal direction perpendicular to the movement in container 1.

The articles cover a relatively wide range, from thin, sensitive letters to compact packages with magazines. At the end of container 1, the articles hit a baffle plate 7 with an elastic surface 9, designed to reduce or eliminate the kinetic energy of the articles. This baffle plate is positioned with a bearing at a rotational point 8, located to the side of container 1. A spring-buffering mechanism 10 is furthermore mounted on the baffle plate 7, which causes a buffered spring-back of the baffle plate 7 when it is hit by an article 6.

This movable baffle plate 7 with the spring-buffering mechanism 10 is dimensioned such that light letters are slowed down without being damaged, without this resulting in a significant bouncing back movement. A longer return movement of thicker, heavier and more stable articles 6 is prevented by the mechanism according to the invention, which is described in the following.

A straight-line, flat member is positioned here as a rigid member 2 on a pivot bearing 3 and projects through an opening into the container 1. A spring element 11 with buffering element acts upon the rigid member 2 and pushes the rigid member 2 in the counter-transporting direction of the articles 6 into the container 1 and against a limit stop 12. This limit stop limits the pivoting range of the rigid member 2, such that a gap for the sensitive, thin letters remains and the rigid member 2 is not damaged. So as to allow the letters to pass through this gap unhindered, a pivotable, smooth guiding device 4 is provided in the transporting direction in front of rigid member 2, which also projects through the opening in the container 1. The thicker and heavier articles 6 bump against the rigid member 2 and push it aside, counter to the force of the buffered spring element 11, so that the article can reach the baffle plate. The rigid member 2 touches the article 6 on its longitudinal side and pushes it against the closed longitudinal side of container 1 or against an article already present in the container 1. The buffering avoids undesirable vibrations.

If the article rebounds from the baffle plate 7 as a result of its kinetic energy, it is clamped tightly between the rigid member 2 and the container wall or the already existing article as a result of non-reversibility. To ensure that this always occurs, the location of the pivot bearing 3, the length of the rigid member 2 and the pivoting range are selected such that during the transport into the container 1, the points of contact between article 6 and rigid member 2 are always located behind the pivot bearing 3, in the transporting direction, and that during the return movement, the point of contact between the rigid member 2 and the article 6, is located in the reverse transporting direction, in front of pivot bearing 3.

In order to support this gliding movement or the clamping in, the rigid member 2 is provided with a teflon coating on the side facing the loading opening of container 1 and is provided with a rubber coating on the side effective for the clamping.

Figure 2:
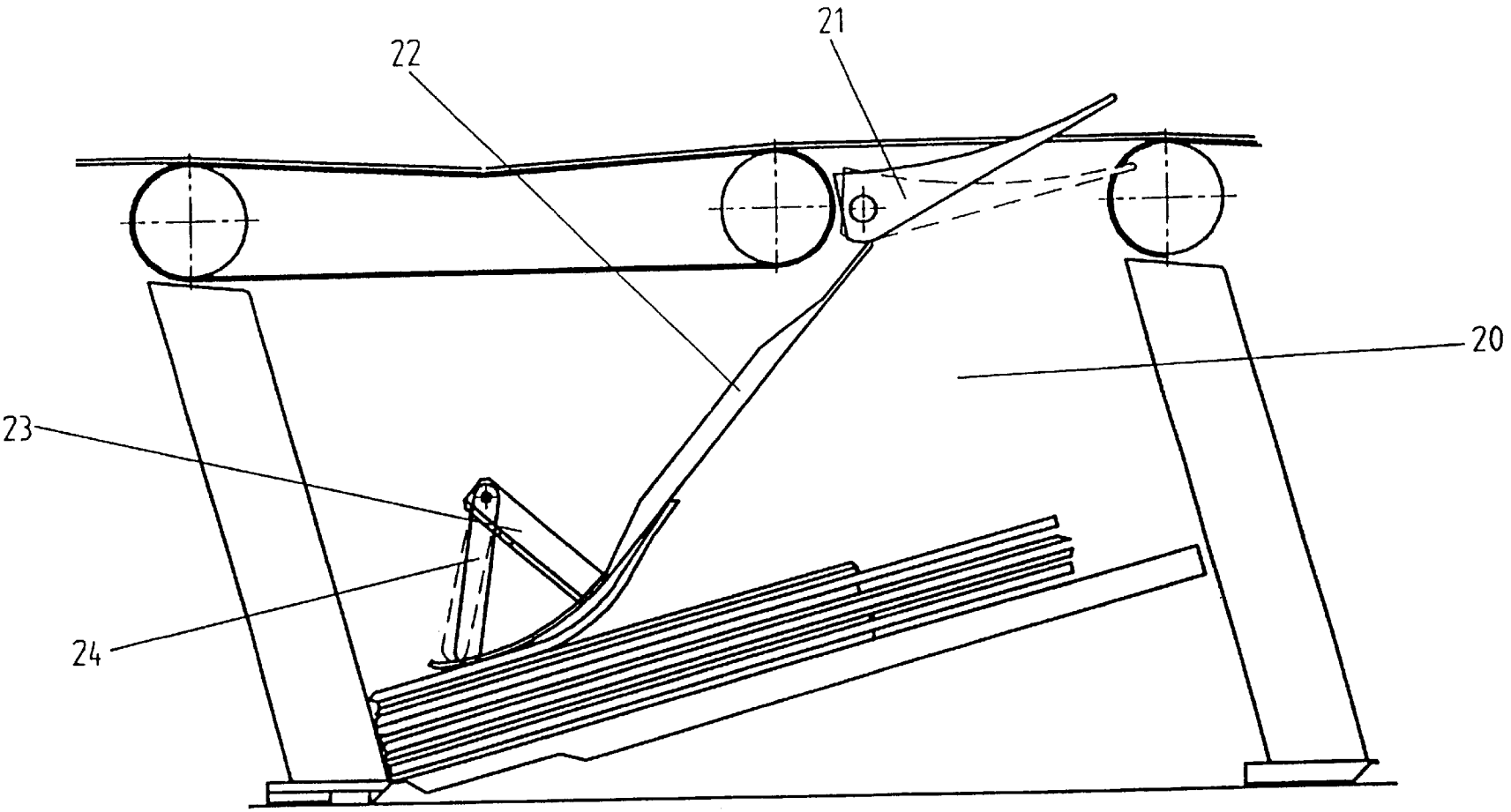
FIG. 2 Shows a schematic side view of a stacking compartment of a sorting machine.

FIG. 2 shows a side view of stacking compartments 20 for an article sorting machine. The articles are directed into the respective stacking compartment 20 via diverter wings 21 and pivoting sheet metal guides 22. The lower side of the sheet metal guides 22 rest on the stack of the articles, which are separated by a platform 25 positioned at an acute angle with respect to the bottom of the compartment 20, and thus move closer to a horizontal position the more the stacking compartment 20 is filled. A support 23 is attached to the upper side of sheet metal guides 22 that are facing away from the articles, so that the articles can assume a defined stack position inside the stacking compartment 20 and return movements are avoided. A rigid member 24 is attached pivoting to the end of this support 23 and, owing to its own gravity, rests on the top article by extending through a slot in the metal guide 22.

The pivoting point for the rigid member 24 during the movement of the article into the stacking compartment 20 in this case is also located in front of the contact point between rigid member 24 and the top article, so that in case of a return movement of the top items as a result of bouncing off the compartment wall 27, the described self-clamping operation takes place.

What is claimed is:

1. An arrangement for positioning a flat article, comprising:

a container having spaced opposing sides for receiving the flat article, an article introduced into a first end of said container between said opposing sides being translated in a forward direction toward a second end of said container;

a rigid member having a pivot bearing and first and second surfaces;

positioning means for resiliently positioning said rigid member within said container at an acute angle extending in the forward direction with respect to a line through said pivot bearing perpendicular to the opposing sides of said container, the translated article striking the first surface of said rigid member and rotating said rigid member in the forward direction about said pivot bearing, whereby the article is translated past said rigid member to the second end of said container; and a baffle plate positioned adjacent the second end of said container, the article impacting said baffle plate rebounding therefrom and impacting the second surface of said rigid member thereby being clamped between a side of said container and the second surface of said rigid member.

2. An arrangement according to claim 1, wherein said positioning means comprises a spring element resiliently contacting the second surface of said rigid member, said rigid member being rotated clockwise against a force of said spring element when an article impinges on said rigid member; and limiting means contacting said rigid member, said limiting means limiting the position reached by said rigid member when said rigid member is rotated counter-clockwise by the force of said spring element.

3. An arrangement according to claim 2, wherein said spring element includes a buffering element, said buffering element minimizing vibrations.

4. An arrangement according to claim 2 wherein said limiting means is a limit stop contacting the first surface of said rigid member, said limit stop limiting the position of said rigid member to provide a gap between said rigid member and a side of said container.

5. An arrangement according to claim 2 wherein said limiting means is a side of said container.

6. An arrangement according to claim 1, wherein the first surface of said rigid member has a friction coefficient which enhances sliding of the article along said rigid member, and the second surface of said rigid member has a higher friction coefficient which assist in detaining the article after rebounding from said baffle plate.

7. An arrangement according to claim 6 wherein the first surface of said rigid member is a teflon coating and the second surface of said rigid member is a rubber coating.

8. An arrangement according to claim 1, wherein the baffle plate includes means for reducing the kinetic energy of the article.

9. An arrangement for positioning a flat article, comprising:

a container having spaced opposing sides for receiving the flat article, an article introduced into a first end of said container between said opposing sides being translated in a forward direction toward a second end of said container;

a rigid member having a pivot bearing and first and second surfaces;

positioning means for resiliently positioning said rigid member within said container at an acute angle in the forward direction with respect to a line through said pivot bearing perpendicular to the opposing sides of said container; and a baffle plate positioned adjacent the second end of said container, said positioning means establishing a gap between said rigid member and a side of said container thereby allowing a relatively thin article to pass through the gap and reach the baffle without contacting said rigid member.

10. An arrangement according to claim 9 wherein said positioning means comprises a spring element resiliently contacting the second surface of said rigid member; and a limit stop contacting the first surface of said rigid member, said limit stop limiting the position of said rigid member to provide the gap between said rigid member and a side of said container.

11. An arrangement according to claim 8 wherein said means for reducing the kinetic energy of the article includes at least one of an elastic surface on said baffle plate and a spring-buffering mechanism.

12. An arrangement according to claim 9, wherein the baffle plate neutralizes nearly all the kinetic energy of the relatively thin article.

13. An arrangement according to claim 9 which further comprises a pivotable guiding device resiliently contacting the first surface of said rigid member, the translated article being guided by said guiding device through the gap between said rigid member and a side of said container.

14. An arrangement according to claim 1 wherein said rigid member projects through an opening in an opposing side of said container, the pivot bearing of said rigid member being located external to said container.

15. An arrangement according to claim 13, wherein said rigid member and said pivotable guiding device project through at least one opening in an opposing side of said container, said rigid member and said guiding device being pivoted about axes external to said container.

16. A stacking device for flat articles, comprising;

a stacking compartment having an end wall and an impute opening therein for insertion of the flat articles;

a platform positioned within said compartment at an acute angle with respect to a horizontal plane;

a pivotal guide having upper and lower surfaces and first and second opposite ends spaced from a surface of said platform, said guide being pivoted at the first end thereof adjacent said input opening, articles inserted in the input opening of said compartment sliding between the lower surface of the second end of said guide and said platform and impinging on said wall;

a support secured to the upper surface of the second end of said guide; and a rigid member having one end pivotally attached to said support and the other end pressed against said articles through an opening in the second end of said guide, the angle between the articles sliding along said guide between said rigid member and said input opening being less than 90 degrees and the angle between said rigid member and said articles after said articles rebound from said end wall being greater than 90 degrees.

* * * * *